US011572737B2

(12) United States Patent
Campagna

(10) Patent No.: US 11,572,737 B2
(45) **Date of Patent: *Feb. 7, 2023**

(54) SHADE MOTOR WITH POWER SUPPLIED BY BRACKETS

(71) Applicant: Crestron Electronics, Inc., Rockleigh, NJ (US)

(72) Inventor: Michael Campagna, Woodcliff Lake, NJ (US)

(73) Assignee: Crestron Electronics, Inc., Rockleigh, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/522,462

(22) Filed: Nov. 9, 2021

(65) Prior Publication Data

US 2022/0065039 A1 Mar. 3, 2022

Related U.S. Application Data

(63) Continuation of application No. 16/245,464, filed on Jan. 11, 2019, now Pat. No. 11,268,322, which is a (Continued)

(51) Int. Cl.
*E06B 9/72* (2006.01)
*A47H 1/13* (2006.01)
(Continued)

(52) U.S. Cl.
CPC ..... *E06B 9/72* (2013.01); *E06B 9/44* (2013.01); *E06B 9/50* (2013.01); *A47H 1/13* (2013.01); *A47H 5/14* (2013.01)

(58) Field of Classification Search
CPC ..... E06B 9/72; A47H 1/13
(Continued)

(56) References Cited

U.S. PATENT DOCUMENTS 4,974,131 A * 11/1990 Paradiso ..... H01R 33/08 362/217.08
6,497,267 B1 * 12/2002 Azar ..... H02K 7/1166 242/906

(Continued)

FOREIGN PATENT DOCUMENTS

EP 2161223 A2 * 3/2010 ..... B65G 23/08
EP 2476812 A2 * 7/2012 ..... E04F 10/0662

(Continued)

*Primary Examiner* — Robert Canfield
(74) *Attorney, Agent, or Firm* — Crestron Electronics, Inc.

(57) ABSTRACT

Shade assembly comprising a roller tube, shade material connected to the roller tube, and a motor disposed inside the roller tube and adapted to rotate the roller tube to roll and unroll the shade material. The shade assembly further comprise a motor head disposed at a terminal end of the roller tube and comprises a contact pin and a first locking member, and an installation bracket adapted to be secured to an architectural structure and comprises a contact pad and a second locking member, wherein the motor head is stationary with respect to the installation bracket when the roller tube rotates. The motor head is adapted to removably attach to the installation bracket by connecting the first locking member to the second locking member and thereby aligning and electrically connecting the contact pin with the contact pad

21 Claims, 7 Drawing Sheets

Related U.S. Application Data continuation-in-part of application No. 15/299,621, filed on Oct. 21, 2016, now Pat. No. 10,221,623.

(51) Int. Cl.
*E06B 9/44* (2006.01)
*E06B 9/50* (2006.01)
*A47H 5/14* (2006.01)

(58) Field of Classification Search
USPC ..... 160/310, 311, 323.1, 368.1
See application file for complete search history.

(56) References Cited

U.S. PATENT DOCUMENTS 7,682,039 B2 * 3/2010 Kuo ..... F21V 23/06 362/640
9,054,475 B2 * 6/2015 Hoffman ..... H01R 33/0836
9,644,424 B2 * 5/2017 Slivka ..... E06B 9/72
10,221,623 B2 * 3/2019 Derk, Jr. ..... A47H 1/13
10,612,301 B2 * 4/2020 Derk, Jr. ..... E06B 9/88
10,738,530 B2 * 8/2020 Campagna ..... E06B 9/42
10,822,872 B2 * 11/2020 Geiger ..... E06B 9/50
11,268,322 B2 * 3/2022 Campagna ..... E06B 9/72
11,396,772 B2 * 7/2022 Campagna ..... H02K 11/24
2004/0112718 A1 * 6/2004 Brixius ..... F16B 21/09 198/788
2004/0129849 A1 * 7/2004 Walker ..... E06B 9/72 248/266
2008/0121353 A1 * 5/2008 Detmer ..... E06B 9/90 160/311
2014/0224437 A1 * 8/2014 Colson ..... E06B 9/72 160/311
2014/0262077 A1 * 9/2014 Watkins ..... E06B 9/68 160/310
2015/0008801 A1 * 1/2015 Schadlich ..... E06B 9/72 310/68 B
2015/0083351 A1 * 3/2015 Campagna ..... E06B 9/50 160/310
2015/0362896 A1 * 12/2015 Feldstein ..... G05B 15/02 700/275
2017/0175440 A1 * 6/2017 Bohlen ..... E06B 9/50
2018/0310745 A1 * 11/2018 Giri ..... E06B 9/58
2021/0131179 A1 * 5/2021 Campagna ..... E06B 9/72

FOREIGN PATENT DOCUMENTS

EP 2716859 A1 * 4/2014 ..... E06B 9/174
JP 06048548 A * 2/1994

* cited by examiner

SHADE MOTOR WITH POWER SUPPLIED BY BRACKETS

BACKGROUND OF THE INVENTION

Technical Field

Aspects of the embodiments described herein generally relate to roller shades, and more specifically to systems, methods, and modes for providing power and/or data to motorized roller shades through cables in a concealed as well as quick and easy detachable manner.

Background Art

Installation of motorized window treatments for use with a sophisticated home automation system can be a challenge. Trying to mount a tube with fabric attached into a small pocket or window frame is hard enough, but before the motorized shade is hung, wire connections must be made for power and/or data signals, while the wire must be kept away from the roller tube. If the wire is not dressed properly, there is a chance that the wire and/or connectors can rub on the roller shade as it moves up and down, creating noise. Worse, the wire can get tangled around the tube damaging the fabric or even the shade motor itself. Further, if the insulation around the wiring is worn off, an electrical fire hazard can present itself.

Another problem is that the wire typically unsightly hangs out of the wall or ceiling, while installers are always trying to determine the best way of concealing the wire. Oftentimes, the wire and connectors are hidden on top of the roller or behind it. While such constructive techniques can be aesthetically pleasing from the inside of the window, the wires might actually not be hidden from the outside of the window. Further, the efforts to hide the wires result in increased installation time and effort, and thus additional costs are incurred. Further still, if the shade is replaced, the ad-hoc concealment of the wiring/connectors can become undone.

Another problem that frequently arises includes maintenance of the shade. As those of skill in the art can appreciate, from time-to-time shade will need to be cleaned and/or repaired. While typically not frequent, dust and dirt can accumulate and cause degradation of different types of materials that shades are made of, or can just plain cause the shade to become unsightly or seem "worn-out." Therefore, from time-to-time, technicians will need to take the shade down for one or more of cleaning, disassemble, and repairs to wiring or other components. Disconnecting and then reconnecting wiring can take time, and if incorrectly done can lead to further issues, and additional repairs.

Accordingly, a need has arisen for providing power and/or data to motorized roller shades through cables in a concealed as well as quick and easy detachable manner.

SUMMARY OF THE INVENTION

It is to be understood that both the general and detailed descriptions that follow are explanatory only and are not restrictive of the embodiments.

It is an object of the embodiments to substantially solve at least the problems and/or disadvantages discussed above, and to provide at least one or more of the advantages described below.

It is therefore a general aspect of the embodiments to provide systems, methods, and modes for providing power and/or data to motorized roller shades through cables in a concealed as well as quick and easy detachable manner.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Further features and advantages of the aspects of the embodiments, as well as the structure and operation of the various embodiments, are described in detail below with reference to the accompanying drawings. It is noted that the aspects of the embodiments are not limited to the specific embodiments described herein. Such embodiments are presented herein for illustrative purposes only. Additional embodiments will be apparent to persons skilled in the relevant art(s) based on the teachings contained herein.

DISCLOSURE OF INVENTION

According to an aspect of the embodiments, a shade assembly is provided comprising a roller tube, a shade material connected at its one end to the roller tube, and a motor disposed inside the roller tube and adapted to rotate the roller tube to roll and unroll the shade material onto and from the roller tube while the motor remains stationary. The shade assembly also comprises a motor head disposed at a terminal end of the roller tube, the motor head comprises a substantially disc shaped motor head locking member having at least one locking tab extending from a side surface thereof and at least one contact pin extending from a terminal end thereof. The shade assembly further comprises a first installation bracket adapted to be secured to an architectural structure and comprising a substantially disc shaped installation bracket locking member comprising at least one locking arm and at least one guiding channel, wherein the at least one guiding channel comprises at least one contact pad disposed therein. The motor head locking member is adapted to removably attach to the installation bracket locking member by aligning the locking tab of the motor head locking member adjacent to the locking arm of the installation bracket locking member, and thereby aligning the contact pin with the guiding channel, and rotating the roller tube until the locking tab is locked by the at least one locking arm and the contact pin comes into electrical contact with at least one contact pad via the guiding channel.

According to an embodiment, the at least one contact pad is adapted to be connected to at least one of a power wire and a data signal wire.

According to an embodiment, the first installation bracket comprises a housing having a side wall and peripheral wall inwardly extending about the side wall, wherein the housing comprises a rear portion adapted to be secured to the architectural structure and a front portion adapted to substantially retain the installation bracket locking member therein. The first installation bracket may comprise an installation bracket module disposed within the housing and behind the installation bracket locking member, wherein the installation bracket module comprises the at least one contact pad disposed thereon. The rear portion of the housing may be adapted to retain a user interface connected to at least one of the contact pads to transmit data signals from the user interface to the motor via at least one contact pad in electrical connection with at least one contact pin. In addition, the rear portion of the housing may comprise at least one termination block connected to a respective contact pad, wherein the termination block is adapted to be connected to an external power or communication network.

According to an embodiment, the installation bracket locking member comprises at least one pair of symmetrical locking arms facing each other and adjacently disposed to form a locking tab receiving area therebetween, wherein during installation the locking tab of the motor head locking member is adapted to be inserted between the locking tab receiving area, wherein the roller tube is rotated in either direction to lock the locking tab with one of the symmetrical locking arms. During installation the roller tube may be rotated toward a direction from which the shade material hangs from the roller tube to further lock the motor head locking member with the installation bracket locking member. According to an embodiment, the installation bracket locking member is disposed about an interface axis, wherein one of the pair of symmetrical locking arms is aligned with a first radius of the installation bracket locking member, and wherein another one of the pair of symmetrical locking arms is aligned with a second radius of the installation bracket locking member, wherein the installation bracket locking member comprises at least one set of a plurality of guiding channels each disposed at a different distance with respect to the interface axis, wherein each guiding channel extends from the first radius to the second radius of the installation bracket locking member, wherein each guiding channel comprises a pair of contact pads disposed therein each contact pad being aligned with the first radius or the second radius, wherein the motor head locking member comprises a plurality of pins each adapted to be receive by at least one guiding channel and come into contact with at least one contact pad.

According to an embodiment, the first installation bracket or the motor head comprises a concealing ring adapted to conceal the motor head locking member and the installation bracket locking member when they are removable attached.

According to another aspect of the embodiments, a shade assembly is provided comprising a roller tube, a shade material connected at its one end to the roller tube, and a motor disposed inside the roller tube and adapted to rotate the roller tube to roll and unroll the shade material onto and from the roller tube while the motor remains stationary. The assembly further comprises a first installation bracket adapted to be secured to an architectural structure and comprising a substantially disc shaped installation bracket locking member, the installation bracket locking member comprises a pair of symmetrical locking arms transversely extending out of the installation bracket locking member in proximity to its periphery forming a locking tab receiving area therebetween, wherein one of the locking arms is aligned with a first radius and the other one of the locking arms is aligned with a second radius, the installation bracket locking member further comprising at least one guiding channel in proximity of the pair of locking arms and extending from the first radius to the second radius, wherein the at least one guiding channel comprises a first contact pad disposed therein along the first radius and a second contact pad disposed therein along the second radius. The assembly further comprises a motor head disposed at a terminal end of the roller tube, the motor head comprises a substantially disc shaped motor head locking member having at least one locking tab extending from a side surface thereof, wherein the motor head locking member further comprises at least one contact pin extending from a terminal end thereof and linearly arranged with the at least one locking tab. The motor head locking member is adapted to removably attach to the installation bracket locking member by aligning the locking tab of the motor head locking member with the locking tab receiving area of the installation bracket locking member, and thereby aligning the contact pin with the guiding channel, and rotating the roller tube until the locking tab is locked by one of the locking arms and the contact pin comes into electrical contact with one of the contact pads via the guiding channel.

According to yet another aspect of the embodiments, a shade assembly is provided comprising a roller tube, a shade material connected at its one end to the roller tube, and a motor disposed inside the roller tube and adapted to rotate the roller tube to roll and unroll the shade material onto and from the roller tube while the motor remains stationary. The assembly further comprises a motor head disposed at a terminal end of the roller tube, the motor head comprises a substantially disc shaped motor head locking member having at least one locking tab extending from a side surface thereof and at least one contact pin extending from a terminal end thereof. The assembly further comprises a first installation bracket adapted to be secured to an architectural structure and comprising a substantially disc shaped installation bracket locking member comprising at least one locking arm and at least one contact pad. The motor head locking member is adapted to removably attach to the installation bracket locking member by aligning the locking tab of the motor head locking member adjacent to the locking arm of the installation bracket locking member and rotating the roller tube until the locking tab is locked by the at least one locking arm and the contact pin comes into electrical contact with the at least one contact pad.

BRIEF DESCRIPTION OF THE DRAWINGS

The above and other objects and features of the embodiments will become apparent and more readily appreciated from the following description of the embodiments with reference to the following figures. Different aspects of the embodiments are illustrated in reference figures of the drawings. It is intended that the embodiments and figures disclosed herein are to be considered illustrative rather than limiting. The components in the drawings are not necessarily drawn to scale, emphasis instead being placed upon clearly illustrating the principles of the aspects of the embodiments. In the drawings, like reference numerals designate corresponding parts throughout the several views.

BRIEF DESCRIPTION OF THE SEVERAL VIEWS OF THE DRAWING

Figure 1:
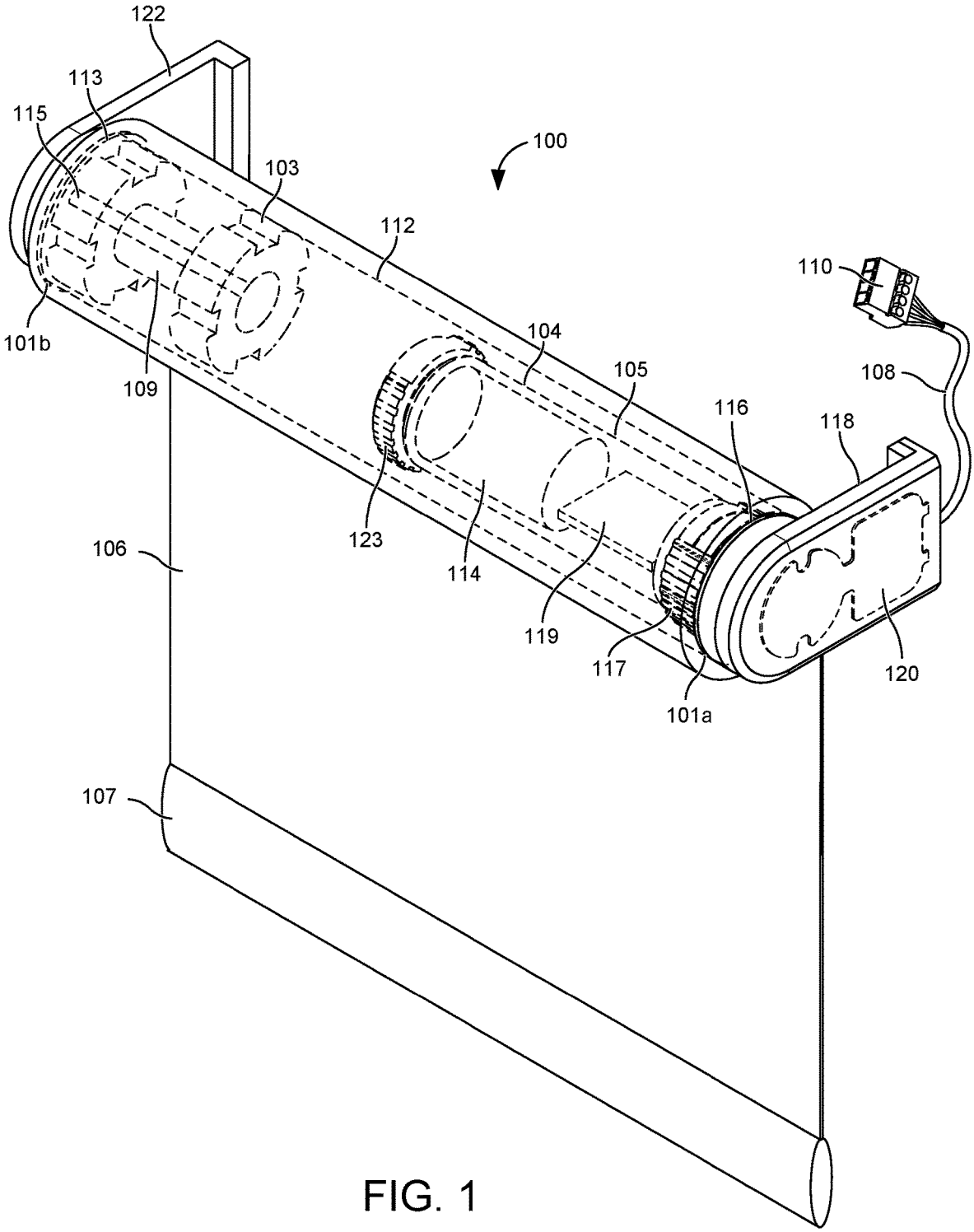

FIG. 1 illustrates a front perspective view of a roller shade assembly according to aspects of the embodiments.

Figure 2:
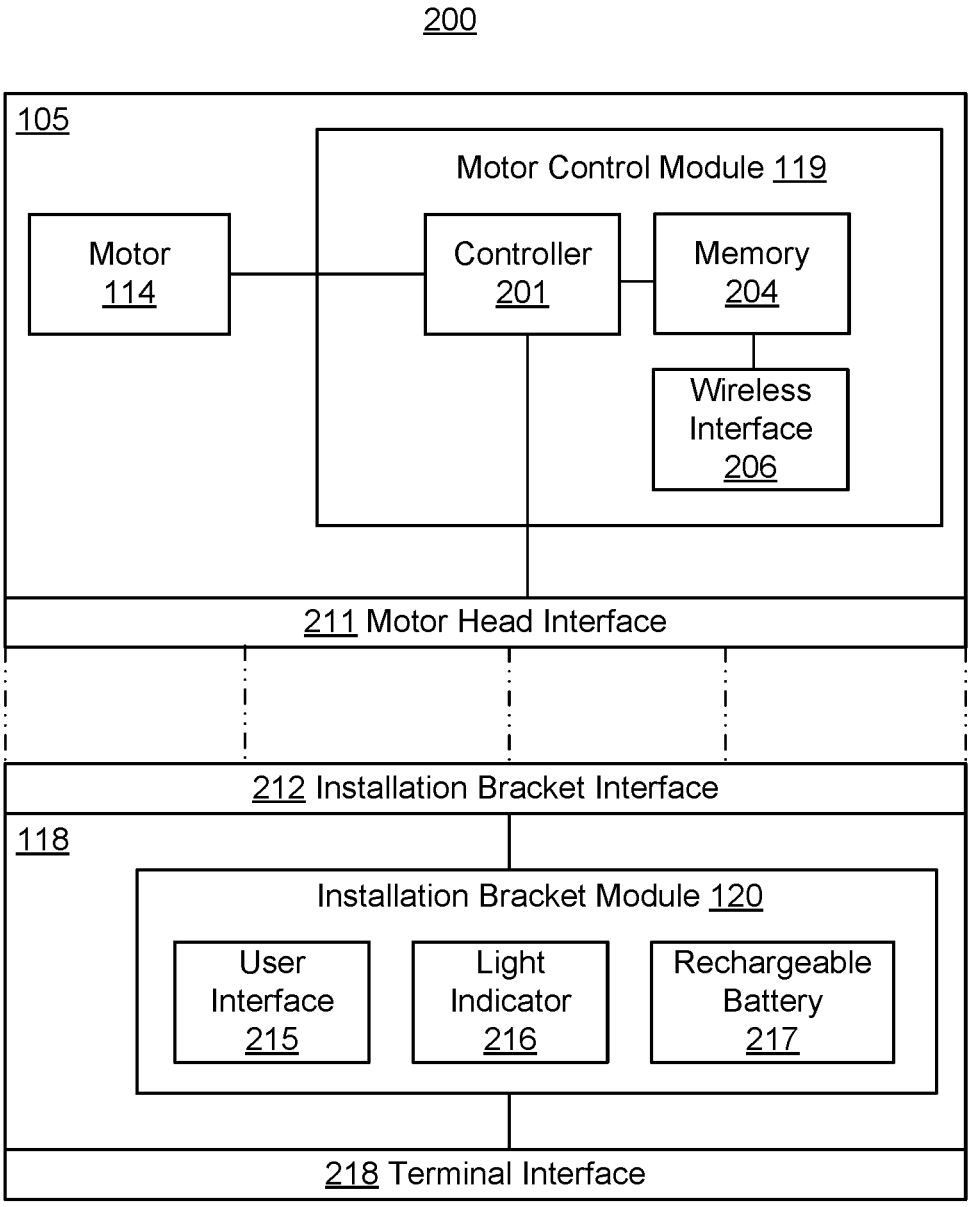

FIG. 2 shows an illustrative block diagram of the motor drive unit of the roller shade assembly as well as the first installation bracket according to aspects of the embodiments.

Figure 3A:
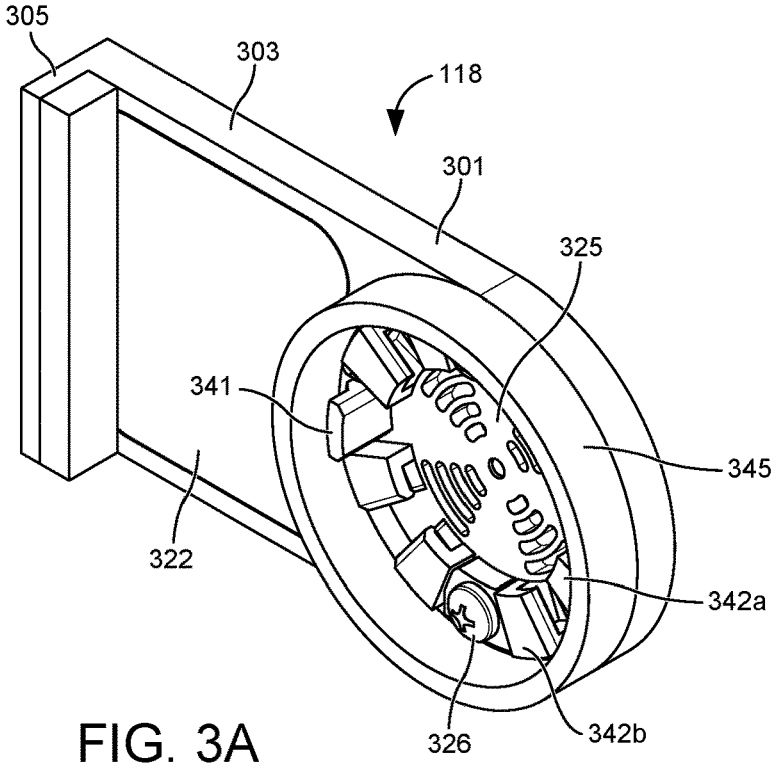

FIG. 3A illustrates a perspective view of the first installation bracket according to aspects of the embodiments.

Figure 3B:
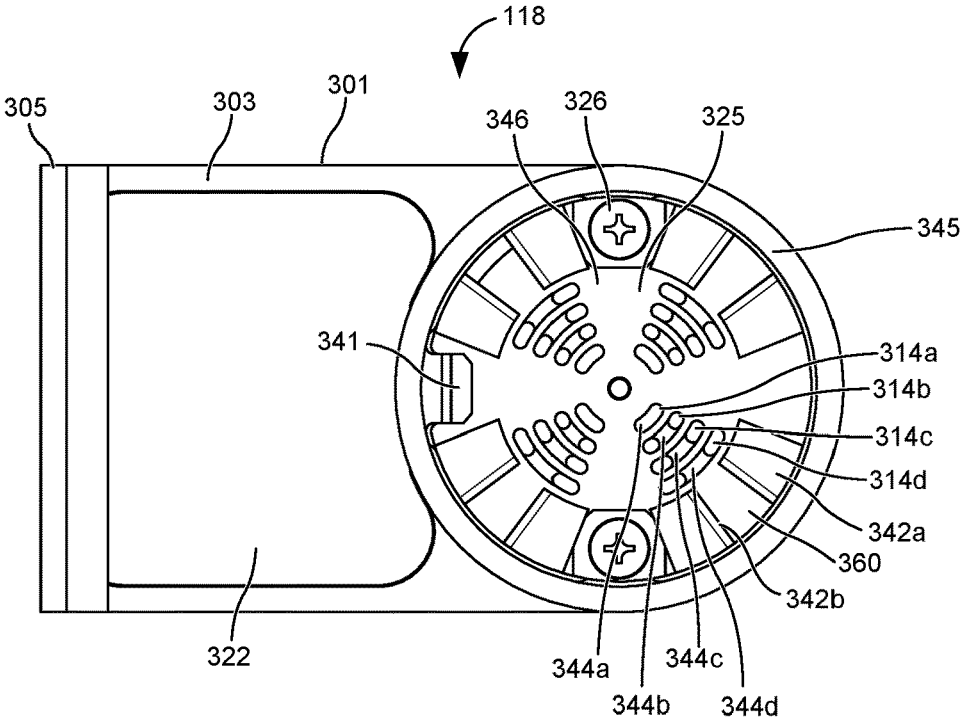

FIG. 3B illustrates an inner view of the first installation bracket according to aspects of the embodiments.

Figure 3C:
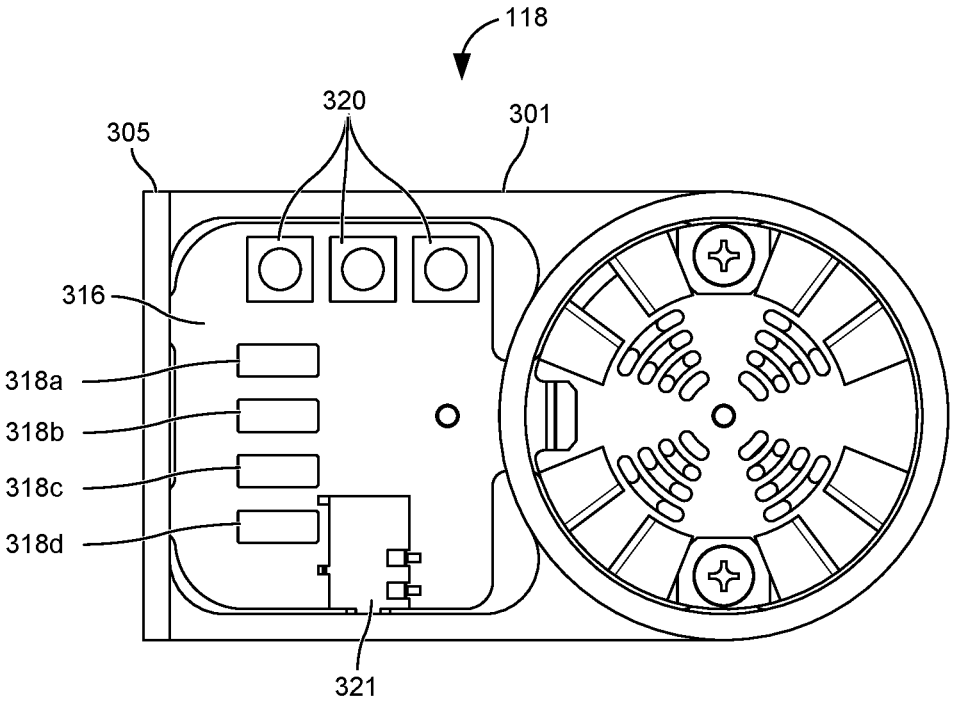

FIG. 3C illustrates an inner view of the first installation bracket with a removable cover removed according to aspects of the embodiments.

Figure 4A:
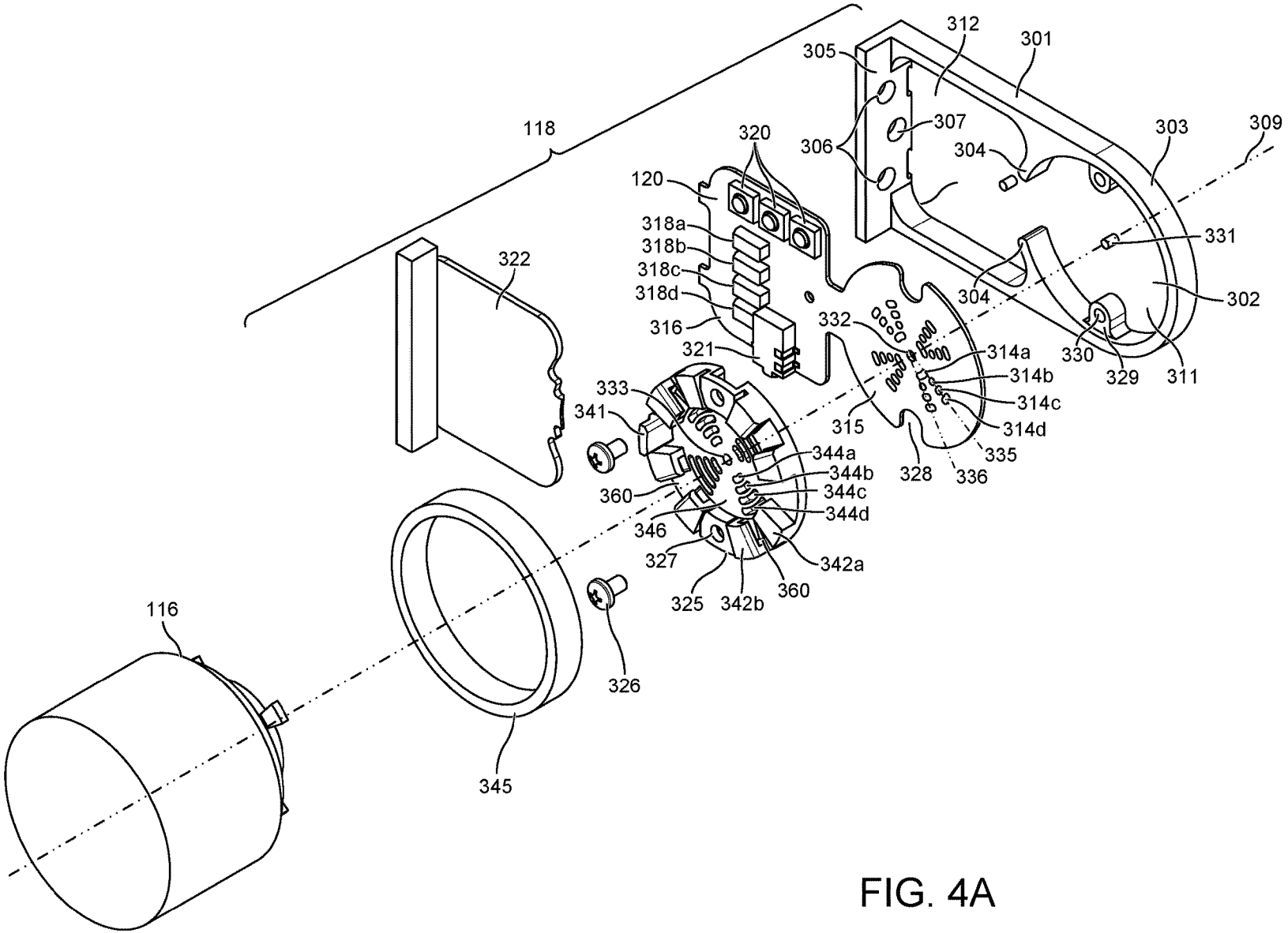

FIG. 4A illustrates an exploded inner perspective view of the first installation bracket as well as the motor head according to aspects of the embodiments.

Figure 4B:
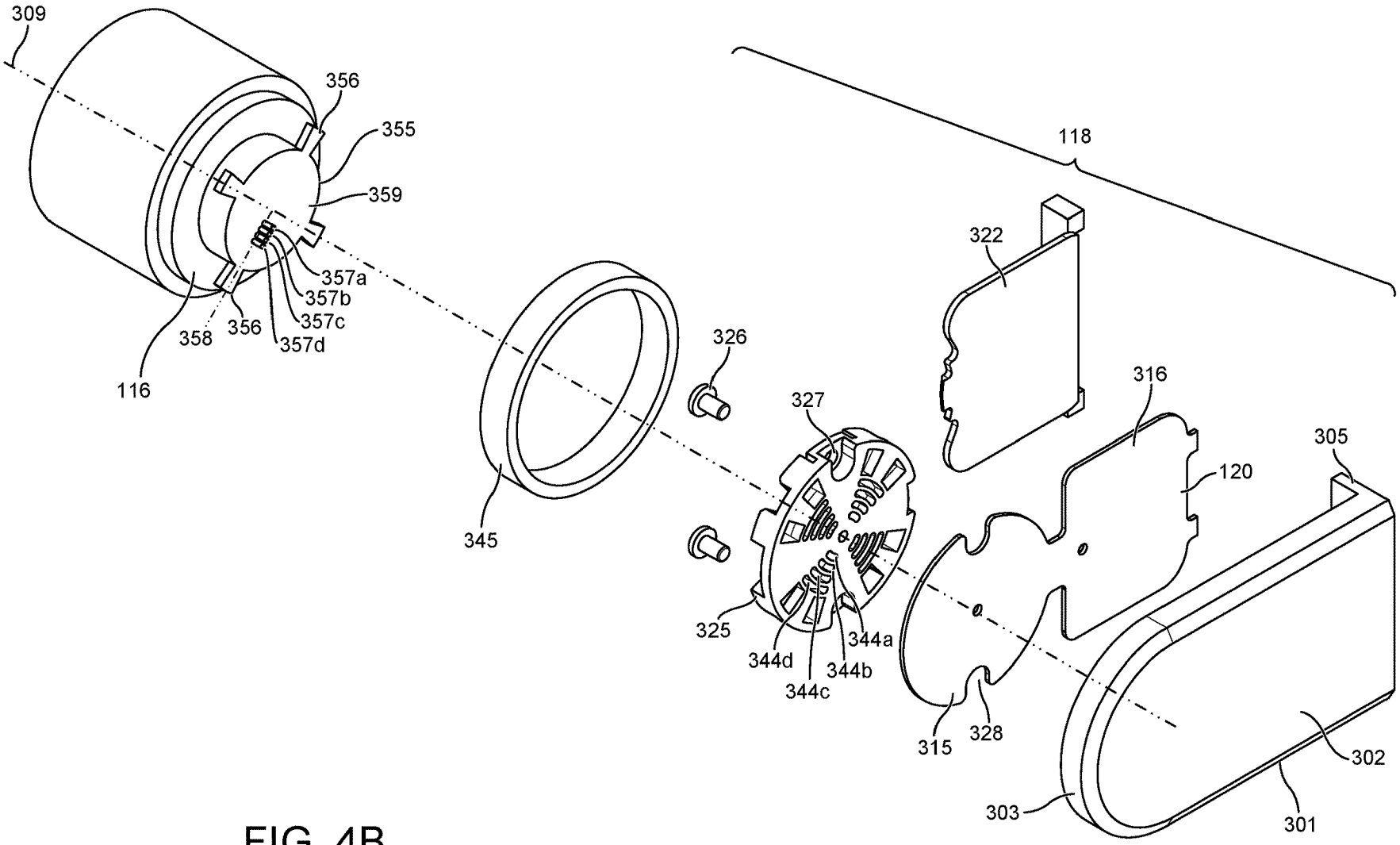

FIG. 4B illustrates an exploded outer perspective view of the first installation bracket well as the motor head according to aspects of the embodiments.

Figure 5:
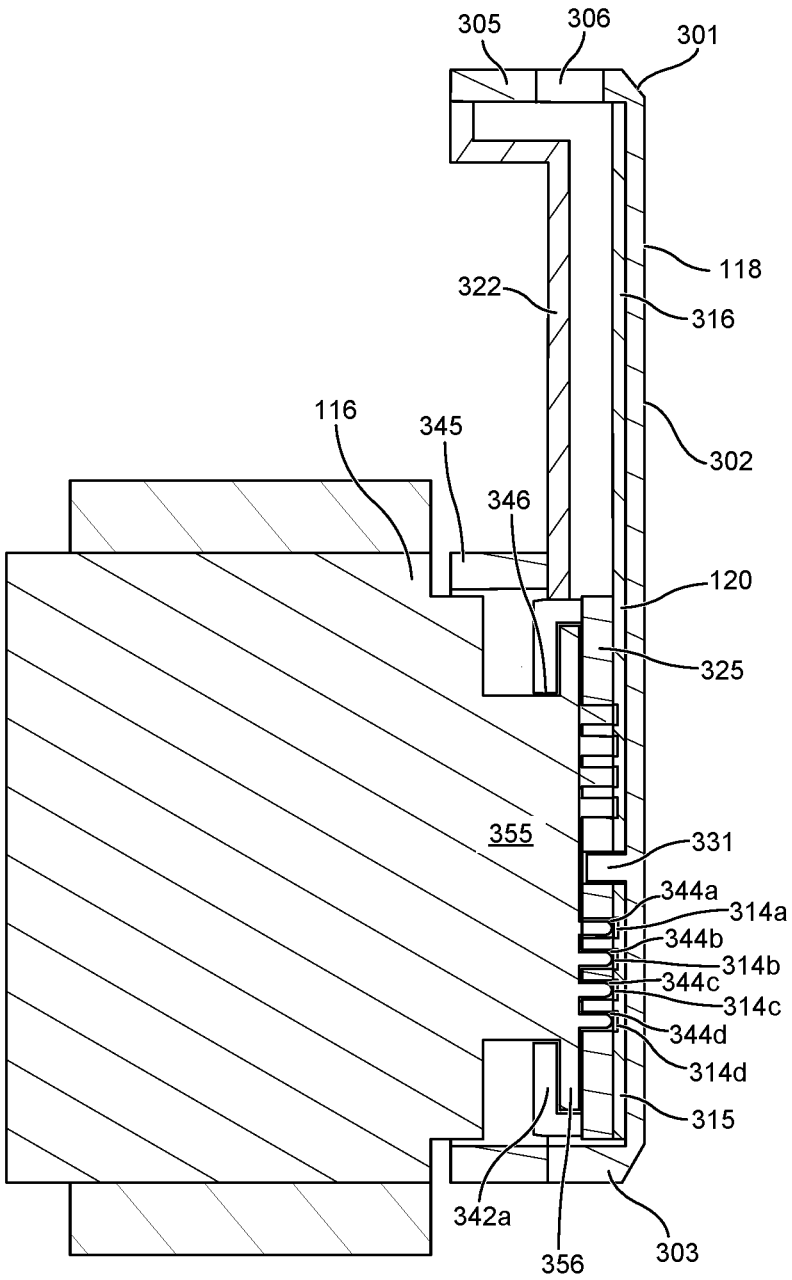

FIG. 5 illustrates a cross sectional view of the motor head connected with the first installation bracket according to aspects of the embodiments.

DETAILED DESCRIPTION OF THE INVENTION

The embodiments are described more fully hereinafter with reference to the accompanying drawings, in which embodiments of the inventive concept are shown. In the drawings, the size and relative sizes of layers and regions may be exaggerated for clarity. Like numbers refer to like elements throughout. The embodiments may, however, be embodied in many different forms and should not be construed as limited to the embodiments set forth herein. Rather, these embodiments are provided so that this disclosure will be thorough and complete, and will fully convey the scope of the inventive concept to those skilled in the art. The scope of the embodiments is therefore defined by the appended claims. The detailed description that follows is written from the point of view of a control systems company, so it is to be understood that generally the concepts discussed herein are applicable to various subsystems and not limited to only a particular controlled device or class of devices, such as motorized roller shades.

Reference throughout the specification to "one embodiment" or "an embodiment" means that a particular feature, structure, or characteristic described in connection with an embodiment is included in at least one embodiment of the embodiments. Thus, the appearance of the phrases "in one embodiment" on "in an embodiment" in various places throughout the specification is not necessarily referring to the same embodiment. Further, the particular feature, structures, or characteristics may be combined in any suitable manner in one or more embodiments.

LIST OF REFERENCE NUMBERS FOR THE ELEMENTS IN THE DRAWINGS IN NUMERICAL ORDER

The following is a list of the major elements in the drawings in numerical order.

100 Roller Shade Assembly
101*a* First End
101*b* Second End
103 Idler Assembly
104 Motor Housing
105 Motor Drive Unit
106 Shade Material
107 Hem Bar
108 Cable
109 Idler Body
110 Terminal Block
112 Roller Tube
113 Flange
114 Motor
115 Idler Pin
116 Motor Head
117 Crown Adapter Wheel
118 First Installation Bracket
119 Motor Control Module
120 Installation Bracket Module
122 Second Installation Bracket
123 Drive Wheel
200 Block Diagram
201 Controller
204 Memory
206 Wireless Interface
211 Motor Head Interface
212 Installation Bracket Interface
215 User Interface
216 Light Indicator
217 Rechargeable Battery
218 Terminal Interface
301 Housing
302 Outer Side Wall
303 Peripheral Wall
304 Tabs
305 Rear Wall
306 Mounting Holes
307 Cable Hole
309 Interface Axis
311 Front Portion
312 Rear Portion
314*a-d* Contact Pads
315 First Portion
316 Second Portion
318*a-d* Termination Blocks
320 Buttons
321 Receptacle
322 Removable Cover
325 Installation Bracket Locking Member
326 Screws
327 Holes
328 Cutouts
329 Posts
330 Threaded Holes
331 Center Post
332 Center Hole
333 Center Hole
335 First Radius
336 Second Radius
341 Thumb lever
342*a-b* Locking Arms
344*a-d* Guiding Channels
345 Concealing Ring
346 Motor Head Receiving Area
355 Motor Head Locking Member
356 Locking Tabs
357*a-d* Pins
358 Third Radius
359 Body
360 Locking Tab Receiving Area

List of Acronyms Used in the Specification in Alphabetical Order

The following is a list of the acronyms used in the specification in alphabetical order.

ASIC Application Specific Integrated Circuit
IR Infrared
LED Light Emitting Diode
NFC Near Field Communication
PCB Printed Circuit Board
PoE Power over Ethernet
RAM Random-Access Memory
RF Radio Frequency
ROM Read-Only Memory
VAC Voltage Alternating Current
VDC Voltage Direct Current

Mode(s) for Carrying Out Aspects of the Embodiments

The different aspects of the embodiments described herein pertain to the context of roller shades, but is not limited thereto, except as may be set forth expressly in the appended claims. While the roller shade is described herein for covering a window, the roller shade may be used to cover doors, wall openings, or the like. The embodiments described herein may further be adapted in other types of window or door coverings, such as inverted rollers, Roman shades, Austrian shades, pleated shades, blinds, shutters, skylight shades, garage doors, or the like.

Disclosed herein are systems, methods, and modes for providing power and/or data through cables in a concealed as well as quick and easy detachable or releasable manner to motorized roller shades, and more particularly to a power supplying bracket that can be attached to a window frame and to which a roller shade can be removably attached in a quick and easy manner. The power supplying bracket provides an electrical interface that delivers electrical power and/or data connection to the motor located within the roller tube of the roller shade.

Referring to FIG. 1, there is shown a perspective view of a roller shade assembly 100 according to one aspect of the embodiments. Shade assembly 100 generally comprises a roller tube 112, a motor drive unit 105, an idler assembly 103, shade material 106, and a hem bar 107. Shade material 106 is connected at its top end to the roller tube 112 and at its bottom end to the hem bar 107. Shade material 106 wraps around the roller tube 112 and is rolled onto and/or unrolled from the roller tube 112 to uncover and/or cover a window, a door, a wall opening, or the like. In various embodiments, the shade material 106 comprises fabric, plastic, vinyl, or other materials known to those skilled in the art.

Roller tube 112 is generally cylindrical in shape and longitudinally extends from a first end 101*a* to a second end 101*b*. In various embodiments, the roller tube 112 comprises aluminum, stainless steel, plastic, fiberglass, or other materials known to those skilled in the art. The first end 101*a* of the roller tube 112 receives the motor drive unit 105, and the second end 101*b* of the roller tube 112 receives the idler assembly 103.

The idler assembly 103 of the roller shade assembly 100 may comprise an idler body 109 rotating about an idler pin 115 disposed therein via one or more ball bearings. The idler body 109 is inserted into the second end 101*b* of the roller tube 112 and is operably connected to the roller tube 112 such that rotation of the roller tube 112 also rotates the idler body 109. The idler body 109 may comprise a flange 113 to prevent the idler body 109 from sliding entirely into the roller tube 112. The terminal end of the idler pin 115 is adapted to attach the roller shade assembly 100 to installation bracket 122.

The motor drive unit 105 may comprise a motor head 116, a crown adapter wheel 117, a motor housing 104 containing a motor control module 119 and motor 114 therein, and a drive wheel 123. The motor drive unit 105 may be inserted into the first end 101*a* of the roller tube 112. The crown adapter wheel 117 and drive wheel 123 are generally cylindrical in shape and are operably connected to roller tube 112, for example through a plurality of channels that mate with complementary projections on the inner surface of the roller tube 112, such that crown adapter wheel 117, drive wheel 123, and roller tube 112 rotate together during operation. The crown adapter wheel 117 may be rotatably attached to the motor housing 104 via ball bearings therein. The crown adapter wheel 117 removably and releasably couples the motor drive unit 105 to the roller tube 112, for example via friction fit. The drive wheel 123 is operably connected to the output shaft of the motor 114 such that rotation of the output shaft rotates and drives the drive wheel 123.

In operation, the roller tube 112 is rotated via the motor drive unit 105 to roll or unroll the shade material 106 onto or from the roller tube 112. Particularly, the motor 114 drives the drive wheel 123, which in turn engages and rotates the roller tube 112. The roller tube 112, in turn, engages and rotates the crown adapter wheel 117 and idler body 109 with respect to the motor 114, while the motor housing 104, including the motor 114 and motor control module 119, remain stationary. As a result, the shade material 106 may be lowered from an opened or rolled up position, when substantially the entire shade material 106 is wrapped about the roller tube 112, to a closed or rolled down position, when the shade material 106 is substantially unrolled from the roller tube 112, and vice versa.

The roller shade assembly 100 is adapted to be mounted between the first and second installation brackets 118 and 122. The first installation bracket 118 may comprise an installation bracket module 120 adapted to interface with the motor control module 119, as described below, to provide power and/or data signals. The first installation bracket 118 can further include cable 108 extending therefrom, which may terminate with a terminal block 110. The terminal block 110 may be connected to a power source to receive power and/or to a communication network to receive data signals. According to an embodiment, a junction box (not shown) may be optionally recessed in the wall right behind the first installation bracket 118. Power connection between the terminal block 110 and power source and/or communication network may be made within the junction box, which can provide a housing for the connectors and in part the cabling that brings the electrical power and, optionally, the data signals to the motor drive unit 105.

Beneficially, the roller shade assembly 100 may be installed after all "finish-work" in a home or building is complete to minimize shade material getting damaged or dirty. Previously, the wiring and interconnects would also be installed after all the "finish work" is completed. Using aspects of the embodiments, the installation brackets 118 and 122 may be first installed and wires are terminated during the construction phase. Once the home/building is finished, roller shade assembly 100 can be installed by simply attaching it to first and second installation brackets 118 and 122 as discussed below. No wiring termination needs to be done, and no special tools are required. Consequently, little or no mess will be made.

FIG. 2 is an illustrative block diagram 200 of the motor drive unit 105 as well as the first installation bracket 118 according to one embodiment. The motor drive unit 105 may comprise the motor 114, a motor control module 119, and a motor head interface 211. The motor control module 119 operates to control the motor 112, directing the operation of the motor 114, including its direction, speed, and position. According to an embodiment, the motor control module 119 may comprise fully integrated electronics. In various embodiments, the motor control module 119 can comprise a controller 201, a memory 204, as well as a wireless interface 206. The first installation bracket 118 may comprise the installation bracket module 120, an installation bracket interface 212, and a terminal interface 218. According to various embodiments, the installation bracket module 120 may comprise a user interface 215, a light indicator 216, and a rechargeable battery 217.

Controller 201 of the motor control module 119 can comprise one or more microprocessors, "general purpose" microprocessors, a combination of general and special purpose microprocessors, or application specific integrated circuits (ASICs). Controller 201 can provide processing capability to provide processing for operation of the motor 114. Memory 204 can be communicably coupled to controller 201 and can store data and executable code. In another embodiment, memory 204 may be integrated into the controller 201. Memory 204 can represent volatile memory such as random-access memory (RAM), but can also include nonvolatile memory, such as read-only memory (ROM) or Flash memory.

According to one embodiment, the motor control module 119 can comprise a wireless interface 206 to remotely control the motor control module 119. Wireless interface 206 may be configured for bidirectional wireless communication with other electronic devices over a wireless network. In various embodiments, the wireless interface 206 can comprise one or more antenna and/or one or more transceivers, such as a radio frequency (RF) transceiver, an infrared (IR) transceiver, or other communication technologies known to those skilled in the art. In one embodiment, the wireless interface 206 communicates using the infiNET EX® protocol from Crestron Electronics, Inc. of Rockleigh, N.J. infiNET EX® is an extremely reliable and affordable protocol that employs steadfast two-way RF communications throughout a residential or commercial structure without the need for physical control wiring. infiNET EX® utilizes 16 channels on an embedded 2.4 GHz mesh network topology, allowing each infiNET EX® device to function as an expander, passing command signals through to every other infiNET EX® device within range (approximately 150 feet or 46 meters indoors), ensuring that every command reaches its intended destination without disruption. In another embodiment, communication is employed using the ZigBee® protocol from ZigBee Alliance. In yet another embodiment, wireless interface 206 may communicate via Bluetooth transmission, IEEE 802.11.nn Wi-Fi communication system, near field communication (NFC) communication system, a cellular communication system, or via other communication technologies known in the art. According to an alternative embodiment, the installation bracket module 120 can in addition or alternatively comprise the wireless interface 206 adapted to receive (or transmit) data signals and communicate same to the motor control module 119 via installation bracket interface 212 and the motor head interface 211.

The motor head interface 211 is adapted to removably interface with the installation bracket interface 212, as described below, to receive power and/or data signals. The installation bracket interface 212 in turn receives power and/or data signals through terminal interface 218 of the first installation bracket 118. For example, power and/or data signals can be supplied to the terminal interface 218 via cable 108 (FIG. 1) by connecting a connector, such as the terminal block 110, to a power supply, such as a CSA-PWS40 or CSA-PWS10S-HUB-ENET power supply, available from Crestron Electronics, Inc. of Rockleigh, N.J. According to various aspects of the embodiments, the terminal interface 218 and in turn the installation bracket interface 212 of the installation bracket module 120 are adapted to provide one of a 120 VAC power, but can alternatively provide low voltage power, such as 24 VAC power, among other AC voltage levels, or can receive 12 VDC power, 18 VDC, or 24 VDC power, among other DC voltage levels.

In another embodiment, the installation bracket module 120 may comprise a rechargeable battery 217 connected to the terminal interface 218 and installation bracket interface 212. The battery 217 may receive power from the terminal interface 218 to recharge the battery 217. The battery 217 may provide power as necessary to the motor control module 119 through the installation bracket and motor head interfaces 211/212. According to an embodiment, battery 217 can be of such size and technology that only trickle charging current is needed to recharge it, and once sufficiently charged (for example, at night time), battery 217 alone can operate motor 114 of the roller shade 100. In another embodiment, battery 217 can be of such size that it only provides emergency power, e.g., only enough energy to move the shade material 106 up or down once or a few times until and unless recharged. According to additional aspects of the embodiments, battery 217 can be non-rechargeable, e.g., a standard alkaline cell/battery pack (among other types), and so can be replaced from time-to-time. In addition, the battery 217 can generate and provide monitoring signals to the motor control module 119 for the controller 201 to monitor the state of battery 217. In yet another embodiment, the first installation bracket 118 may provide power to the motor control module 119 from solar panels connected to the terminal interface 218 and placed in proximity to the window to aggregate solar energy.

The terminal interface 218 can further interface with a communication network, such as a local area network and/or the internet, to provide bidirectional communication with other devices over a wired network, for example to receive control commands from an external control point, such as a homeowner running an application on a smart phone. The installation bracket interface 212 can in turn interact with the motor head interface 211 to provide the data or communication signals to the motor control module 119.

In various aspects of the embodiments, the motor control module 119 may receive both power and data signals via the installation bracket module 120. According to an embodiment, the terminal interface 218, installation bracket interface 212, and motor head interface 211 can represent, for example, an Ethernet or a Cresnet® interface. Cresnet® provides a network wiring solution for Crestron® keypads, lighting controls, thermostats, and other devices. The Cresnet® bus offers wiring and configuration, carrying bidirectional communication and 24 VDC power to each device over a simple 4-conductor cable. The communication and power interfaces 218/212/211 can also represent other types of interfaces, such as a Power over Ethernet (PoE) interface, for delivery of both power and data signals.

According to an embodiment, the installation bracket module 120 can further comprise a user interface 215, such as a buttons disposed on the first installation bracket 118, as described below, to provide commands to the motor control module 119 via the motor head and installation bracket interfaces 211/212. For example, using the user interface 215, a user can set up the motor drive unit 105 after installation in the field, such as to set the shade upper and lower limits. Furthermore, the installation bracket module 120 may comprise a light indicator 216, such as a multicolor light emitting diode (LED), disposed on the first installation bracket 118, for indicating the motor status.

According to various embodiments, the data signals, such as control commands, received by the controller 201 may be a direct user input to the controller 201 from the user interface 215 or a wired or wireless signal from an external control point through interfaces 211/212/218 or wireless interface 206. For example, the controller 201 may receive a control command from a wall-mounted button panel or a touch-panel in response to a button actuation or similar action by the user. Control commands may also originate from a signal generator such as a timer or a sensor. Accordingly, the motor control module 119 can integrate seamlessly with other control systems using the installation bracket module 120 to be operated from keypads, wireless remotes, touch screens, and wireless communication devices, such as smart phones. Additionally, the motor control module 119 can be integrated within a large scale building automation system or a small scale home automation system and be controllable by a central control processor, such as the PRO3 control processor available from Crestron Electronics, Inc., that networks, manages, and controls a building management system.

FIGS. 3A-3C illustrate the construction of the first installation bracket 118 in a greater detail, where FIG. 3A illustrates a perspective inner view of the installation bracket 118, FIG. 3B illustrates an inner view thereof, and FIG. 3C illustrates an inner view thereof with a removable cover 322 removed. In addition, FIGS. 4A and 4B illustrate exploded inner and outer perspective views of the first installation bracket 118 as well as the motor head 116. Furthermore, FIG. 5 illustrates a cross sectional view of the motor head 116 connected with the first installation bracket 118.

First installation bracket 118 comprises housing 301 having an outer side wall 302 (FIG. 4A) and a peripheral wall 303 inwardly extending about the top end, front end, and bottom end of the side wall 302. Housing 301 may further comprise a rear wall 305 inwardly extending from the rear end of the side wall 302 and connected to the edges of the peripheral wall 303. Housing 301 may further comprise a pair of tabs 304 inwardly extending from the peripheral wall 303 at about the center of the side wall 302. The paid of tabs 304 cooperate with the peripheral wall 303 to form a substantially ring shaped front portion 311 and a substantially rectangular rear portion 312, although other shapes may be used. According to an embodiment, the front portion 311 is centered about an interface axis 309. The rear wall 305 may include one or more mounting holes 306 adapted to receive screws (not shown) for securing the installation bracket 118 to a structural surface, such as a wall or a window frame. The rear wall 305 may further comprise a cable hole 307 adapted to receive the cable 108 therethrough.

The first installation bracket 118 may further comprise an installation bracket module 120, for example in a form of a printed circuit board (PCB), for providing the installation bracket interface 212 and terminal interface 218 discussed above. The installation bracket module 120 may comprise a first portion 315 connected to a second portion 316. Although a single PCB is illustrated for the installation bracket module 120, two or more PCBs may be used. The first portion 315 may comprise a substantially disc shape dimensioned and sized to fit and reside within the front portion 311 of housing 301 with its center aligned with the interface axis 309. The second portion 316 of the installation bracket module 120 may be dimensioned and sized to fit and reside within the rear portion 312 of housing 301 of the installation bracket 118.

The first portion 315 of the installation bracket module 120 may be adapted to house the installation bracket interface 212, particularly in the form of at least one set of contact pads 314*a-d*. According to an embodiment, eight sets of contact pads 314*a-d* may be provided. Although in other embodiments, other number of sets of contact pads may be provided, including for example a single set of contact pads 314*a-d*, four sets of contacts pads 314*a-d*, or the like. Each set of contact pads 314*a-d* may comprise a number of pads corresponding to the number of wires included in cable 108 to provide power and/or data signals. For example, for both power and data signals, four contact pads 314*a*, 314*b*, 314*c*, and 314*d* may be provided in each set, two for power and two for data signals. The second portion 316 of the installation bracket module 120 may house the terminal interface 218 in the form of termination blocks 318*a-d* that receive the exposed ends of the wires in cable 108 to make electrical contact with the second portion 316 of the installation bracket module 120. In the example shown, four termination blocks 318*a-d* are utilized, two for power wires and two for data signal wires. The termination blocks 318*a-d* are adapted to be electrically connected to respective contact pads 314*a-d*. For example, contact pads 314*a* of all the sets may be all connected to termination block 318*a* associated with ground, contact pads 314*b* of all the sets may be all connected to termination block 318*b* associated with hot power signal, contact pads 314*c* of all the sets may be all connected to termination block 318*c* associated with a first data signal, and contact pads 314*d* of all the sets may be all connected to termination block 318*d* associated with a second data signal for bidirectional data communication. Although other number of termination blocks and pads may be provided in each set, for example only two for only power. According to an embodiment, the contact pads 314*a-d* in each set are linearly arranged along a radius at different distances with respect to the interface axis 309. For example, contact pads 314*a-d* in one set may be aligned along a first radius 335 of the first portion 315 and contact pads 314*a-d* in another set may be aligned along a second radius 336 of the first portion 315.

A removable cover 322 may be provided to cover the second portion 316 of the installation bracket module 120 from view. According to an alternative embodiment, second portion 316 of the installation bracket module 120 may be covered by a permanent cover or portion of the installation bracket housing 301. The second portion 316 of the installation bracket module 120 may also house the user interface 215 in the form of a plurality of buttons 320. According to one embodiment, the buttons 320 may be accessed by removing the removable cover 322. According to another embodiments, the removable cover 322 or a non-removable cover may be provided with holes through which the buttons 320 may extend. The buttons 320 may be electrically connected to at least one contact pad 314*a-d* to transmit data signals to the controller 201 for configuring and controlling different aspects of operation of the motor 114 according to aspects of the embodiments. For example, an "Up" button can command the controller 201 to operate the motor 114 to raise the shade material 106, a "Down" button to lower the shade material 106, and a "Set" button to set operating limits, such as an upper limit and a lower limit. Additional buttons can be included, for example to increase/decrease the rate of rotation of motor 114, or perform other functions, according to further aspects of the embodiments. In addition, or alternatively to the buttons 320, the user interface 215 may comprise a receptacle 321 into which a box with remote buttons can be plugged for situations where buttons 320 cannot be easily accessed.

To removably engage the motor head 116, the first installation bracket 118 further comprises a substantially disc shaped locking member 325 (FIG. 4A). The locking member 325 may be sized to substantially reside within the front portion 311 of housing 301 of the installation bracket 118 over the first portion 315 of the installation bracket module 120, such that its center is also aligned with the interface axis 309. The locking member 325 may be secured to the housing 301 of the installation bracket 118 using a pair of screws 326 extending through a pair of holes 327 in the locking member 325 and threadably secured to threaded holes 330 in a pair of posts 329 traversely extending from the inner surface of outer side wall 302 of the installation bracket housing 301. The first portion 315 may comprise a pair of cutouts or holes 328 adapted to receive the posts 329 of the installation bracket housing 301 such that the first portion 315 is properly aligned with the interface axis 309. For further alignment, the front portion 311 of the installation bracket 119 may comprise a center post 331 extending from the inner surface of the outer side wall 302 at the interface axis 309, which is adapted to be received within a center hole 332 of the first portion 315 of module 120 and a center hole 333 of the locking member 325 to align the front portion 311 of housing 301, first portion 315 of module 120, and the locking member 325 with respect to the interface axis 309. Additional or fewer posts may also be provided.

According to an embodiment, the locking member 325 may comprise a thumb lever 341 adapted to retain the removable cover 322, although other mechanisms may be used which may be located directly on the installation bracket housing 301. The thumb lever 341 may be pulled back to detach and remove the removable cover 322 to give access to buttons 320.

The locking member 325 may further comprise a plurality pairs of symmetrical locking arms, such as arms 342*a* and 342*b*. According to various embodiments, the locking member 325 may comprise a single locking arm (e.g., 342*a*), one pair of symmetrical locking arms (e.g., 342*a-b*), or a plurality of pairs of locking arms (such as four pairs as illustrated in the figures). The locking arms 342*a-b* may transversely extend out of the locking member 325 in proximity to the periphery of the locking member 325 forming a motor head receiving area 346 therebetween at the center of the locking member 325. Each locking arm 342*a-b* may comprise a substantially "L" shaped body, for example in a form of a "hook". Each pair of locking arms 342*a-b* may have the two "L" shaped bodies symmetrically facing each other and adjacently disposed to form a locking tab receiving area 360 therebetween. The first locking arm 342*a* may be aligned with the first radius 335 and the second locking arm 342*b* may be aligned with the second radius 336.

In addition, the locking member 325 may comprise a plurality of sets of guiding channels 344*a-d* disposed within the motor head receiving area 346 and traversing the locking member 326. The guiding channels 344*a-d* in each set may be linearly aligned and disposed at different distances with respect to the interface axis 309. According to an embodiment, each guiding channel may be aligned with, extending, and disposed over two respective contact pads of two adjacent sets. For example, channel 344*d* may extend between contact pad 314*d* of one set at first radius 335 and contact pad 314*d* of another set at a second radius 336. Each guiding channel may be curved and extend from the first radius 335 to the second radius 336. In the embodiment shown in the figures, four guiding channels 344*a-d* may be provided for every pair of adjacently disposed sets of contact pads 314*a-d*.

The first installation bracket 119 may further comprise a concealing ring 345 which may be removably or permanently secured about the front portion 311 of the installation bracket 119. According to an alternative embodiment, the concealing ring 345 may be removably or permanently secured about the end of the motor head 116. The concealing ring 345 is adapted to conceal the components of the motor head interface 211 disposed on the motor head 116 and the components of the installation bracket interface 212 disposed on the installation bracket 119.

Referring to FIG. 4B, the motor head 116 may comprise a motor head locking member 355 extending from a terminal end of the motor head 116. The motor head locking member 355 comprises the motor head interface 211 and is adapted to removably attach to the installation bracket locking member 325. The motor head locking member 355 may comprise a disc shaped body 359 sized to fit within the motor head receiving area 346 in the motor head locking member 325. The motor head locking member 355 may further comprise one or more locking tabs 356, for example four locking tabs, traversely extending from the side surface of the locking member body 359. Each locking tab 356 is adapted to be received and locked by one of the locking arms 342*a-b* of the symmetric pairs of locking arms. The motor head locking member 355 may further comprise a plurality of pins 357*a-d* extending from its terminal end. Pins 357*a-d* can be in the form of spring-loaded pins, commonly referred to as "pogo-pins", so that they can be kept in a compressive fitting with contact pads 314*a-d*. Pins 357*a-d* can have different size springs with different spring constants, meaning that different amounts of force are required to compress them. In addition, such pins can have a number of different lengths, diameters, shapes, and head designs (the head being the portion that makes electrical contact), and can be rated for different amounts of voltage and current. Pins 357*a-d* comprise the motor head interface 211 and are connected to the motor control module 119 to provide power and/or data signals. For example, four pins 357*a-d* may be used as illustrated in FIG. 4B, two for power and two for data signals. Pins 357*a-d* may be linearly arranged along a third radius 358 on the terminal end of the motor head locking member 355, each at a different distance with respect to the interface axis 309. According to an embodiment, pins 357*a-d* are linearly arranged with one of the locking tabs 356 such that said locking tab 356 is also arranged along the third radius 358.

According to an embodiment, the second installation bracket 122 (FIG. 1) may comprise a profile and outer design substantially similar to the first installation bracket 118 such that it is virtually indistinguishable from the first installation bracket 118. The second installation bracket 122, however, does not comprise an installation bracket interface 212, including the installation bracket module 120 or the installation bracket locking member 325. Instead, the second installation bracket 122 may comprise a keyhole adapted to retain the idler pin 115 of the idler assembly 103.

During installation, the first and second installation brackets 118 and 122 are mounted within a window frame or onto the wall in front of the window frame at an uppermost position of about window as known to those of skill in the art. The first installation bracket 118 can be wired to a power supply and/or communication network, for example by plugging the terminal block 110 into a respective receptacle. The roller shade assembly 100 may be then mounted to the second installation bracket 122 by inserting the terminal end of the idler pin 115 into the keyhole in the second installation bracket 122. The roller shade assembly 100 may be then mounted to the first installation bracket 118. In particular, the locking tabs 356 (FIG. 4B) may be aligned with and inserted into the locking tab receiving areas 360 (FIG. 4A)

between respective pairs of locking arms 342*a-b*. This causes the disc shaped motor head locking member body 359 to be inserted into the motor head receiving area 346 of the locking member 355 and the pogo pins 357*a-d* to be inserted into respective guiding channels 344*a-d*. The roller shade assembly 100 may be then rotated in either direction, to bring each locking tab 356 towards a respective first locking arm 342*a* or towards a respective second locking arm 342*b* until the locking tab 356 is locked by the first locking arm 342*a* or the second locking arm 342*b*. This also causes each pin 357*a-d* to travel within a respective guiding channel 344*a-d* until it comes into contact with a respective contact pad 314*a-d* in a first set along radius 335 or with a respective contact pad 314*a-d* in a second set along radius 336, depending on the direction of rotation of the roller shade assembly 100, as greater shown in FIG. 5. Power and/or data signals can then travel between contacting pins 357*a-d* and respective contact pads 314*a-d*.

According to an embodiment, the roller shade assembly 100 is rotated toward the side from which the shade material 106 hangs. As such, the lock direction is dictated by the direction of the pull of the shade material 106. This ensures that the roller shade assembly 100 does not get dislodged from the installation bracket 118, if for example someone pulls on the shade material 106 or the hem bar 107. Instead, pulling on the shade material 106 or hem bar 107 further locks the motor head locking member 355 with the installation bracket locking member 325.

In a preferred embodiment, at least two oppositely disposed symmetric pairs of locking arms 342*a-b*, two oppositely disposed locking tabs 356, and two oppositely disposed pairs of contact pads 314*a-d* are provided for optimal operation. This allows the roller shade assembly 100 to be installed with the motor drive unit 105 on the right side of the roller tube 112 or on the left side of the roller tube 112, or with the shade material 106 in a regular roll configuration (where the shade material 106 rolls off the rear end of the roller shade assembly 100 as shown in FIG. 1), or in a reverse roll configuration (where the shade material 106 rolls off the front end of the roller shade assembly). However, other number of corresponding locking arms, locking tabs, and contact pads may be implemented. For example, only two of the first locking arms 342*a* and two locking tabs 356 may be provided in a roller shade assembly 100 that is adapted to be installed with the motor on only one side and for only one type of shade material roll direction.

Beneficially, the first installation bracket 118 can be secured to window frame and wired with a power supply and/or communication before installing the roller shade assembly 100. The roller shade assembly 100 can be later removably installed between the first and second installation brackets 118 and 122, minimizing damage to the roller shade assembly 100. Use of, and the interaction between the first installation bracket 118 and the motor head 116 of the roller shade assembly 100 as a means for providing power and/or data signals can substantially reduce the light gap between the window frame and shade material 106. As those of skill in the art can appreciate, a light gap—the gap between the window frame and the shade—detracts from the ability of the shade system to effectively block light. That is, even if the shade material 106 itself is made from the most opaque of materials but there is a substantial light gap to either or both sides of shade 106, light can penetrate the room when not desired (e.g., the shades are all the way down). However, interconnection of the first installation bracket 118 and the motor head 116 in the manner described herein to provide power and/or data signals to the shade motor controller eliminates or substantially reduces extraneous or spurious light from entering the room making the shade system more effective according to aspects of the embodiments. In addition, the roller shade assembly 100 may be later quickly and easily removed from the installation brackets 118 and 122 for maintenance, without causing any damage to the shade material 106 or disturbing any wiring.

INDUSTRIAL APPLICABILITY

To solve the aforementioned problems, the disclosed embodiments provide systems, methods, and modes for providing power and/or data to motorized roller shades through cables in a concealed as well as quick and easy detachable manner. It should be understood that this description is not intended to limit the embodiments. On the contrary, the embodiments are intended to cover alternatives, modifications, and equivalents, which are included in the spirit and scope of the embodiments as defined by the appended claims. Further, in the detailed description of the embodiments, numerous specific details are set forth to provide a comprehensive understanding of the claimed embodiments. However, one skilled in the art would understand that various embodiments may be practiced without such specific details.

Although the features and elements of aspects of the embodiments are described being in particular combinations, each feature or element can be used alone, without the other features and elements of the embodiments, or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

The above-described embodiments are intended to be illustrative in all respects, rather than restrictive, of the embodiments. Thus the embodiments are capable of many variations in detailed implementation that can be derived from the description contained herein by a person skilled in the art. No element, act, or instruction used in the description of the present application should be construed as critical or essential to the embodiments unless explicitly described as such. Also, as used herein, the article "a" is intended to include one or more items.

Additionally, the various methods described above are not meant to limit the aspects of the embodiments, or to suggest that the aspects of the embodiments should be implemented following the described methods. The purpose of the described methods is to facilitate the understanding of one or more aspects of the embodiments and to provide the reader with one or many possible implementations of the processed discussed herein. The steps performed during the described methods are not intended to completely describe the entire process but only to illustrate some of the aspects discussed above. It should be understood by one of ordinary skill in the art that the steps may be performed in a different order and that some steps may be eliminated or substituted.

All United States patents and applications, foreign patents, and publications discussed above are hereby incorporated herein by reference in their entireties.

ALTERNATE EMBODIMENTS

Alternate embodiments may be devised without departing from the spirit or the scope of the different aspects of the embodiments.

What is claimed is:

1. A shade assembly comprising:

a roller tube;

a shade material connected to the roller tube;

a motor disposed inside the roller tube and adapted to rotate the roller tube to roll and unroll the shade material;

a motor head disposed at a terminal end of the roller tube and comprises a contact pin and a first locking member; and an installation bracket adapted to be secured to an architectural structure and comprises a contact pad and a second locking member;

wherein the motor head is adapted to removably attach to the installation bracket by connecting the first locking member to the second locking member and thereby aligning and electrically connecting the contact pin with the contact pad, wherein the motor head is stationary with respect to the installation bracket when the roller tube rotates.

2. The shade assembly of claim 1, wherein the first locking member comprises a disc shaped body and wherein the second locking member comprises a disc shaped receiving area sized to receive the disc shaped body of the first locking member.

3. The shade assembly of claim 1, wherein the first locking member comprises a first locking tab and wherein the second locking member comprises a first locking arm adapted to receive and lock the first locking tab therein.

4. The shade assembly of claim 3, wherein the motor head is adapted to removably attach to the installation bracket by aligning the first locking tab with the first locking arm and rotating the roller tube until the locking tab is locked by the locking arm.

5. The shade assembly of claim 3, wherein the second locking member comprise a guiding channel, wherein the contact pad is disposed within the guiding channel, and wherein the contact pin is received within the guiding channel when the motor head is attached to the installation bracket.

6. The shade assembly of claim 5, wherein the guiding channel radially extends from a first end to a second end along the second locking member, wherein the contact pad is disposed within the second end of the guiding channel, wherein the motor head is adapted to removably attach to the installation bracket by aligning the first locking member with the second locking member such that the contact pin is inserted proximate to the first end of the guiding channel and rotating the roller tube until the first locking member is locked by the second locking member and the contact pin is received proximate to the second end of the guiding channel and electrically contacts the contact pad.

7. The shade assembly of claim 1, wherein the motor head is adapted to removably attach to the installation bracket by aligning the first locking member with the second locking member and rotating the roller tube until the first locking member is locked by the second locking member.

8. The shade assembly of claim 1, wherein the installation bracket comprises a side wall and a rear wall laterally extending from a rear end of the side wall, wherein the rear wall is adapted to be secured to the architectural structure and wherein the side wall is adapted to support the roller tube.

9. The shade assembly of claim 8, wherein the contact pad is electrically connected to a wire, wherein the rear wall comprises a hole adapted to receive the wire therethrough.

10. The shade assembly of claim 9, wherein the wire is adapted to transmit at least one of power, data, or any combination thereof.

11. The shade assembly of claim 9, wherein the installation bracket comprises a printed circuit board comprising a termination block, wherein the contact pad is disposed on the printed circuit board, and wherein the wire is electrically connected to the termination block.

12. The shade assembly of claim 11, wherein the installation bracket further comprises a peripheral wall inwardly extending about a front end, a top end, and a bottom end of the side wall, wherein the printed circuit board is recessed within the peripheral wall.

13. The shade assembly of claim 11, wherein the printed circuit board comprises a first portion electrically connected to a second portion, wherein the first portion comprises the contact pad and the second portion comprises the termination block.

14. The shade assembly of claim 13, wherein the second portion further comprises a user interface electrically connected to the contact pad.

15. The shade assembly of claim 14, wherein the installation bracket further comprises a removable cover removably connected to the installation bracket and adapted to cover the second portion and removably uncover the second portion such that the user interface is accessible when the motor head is attached to the installation bracket.

16. The shade assembly of claim 13, wherein when the motor head is attached to the installation bracket the first portion is covered by the motor head without covering the second portion.

17. The shade assembly of claim 11, wherein the second locking member is disposed over and covers the first portion of the printed circuit board, and wherein the second locking member comprise a channel adapted to receive the contact pin therethrough such that the contact pin can contact the contact pad on the first portion of the printed circuit board.

18. The shade assembly of claim 1, wherein the installation bracket or the motor head comprises a concealing ring adapted to conceal the first locking member and the second locking member when they are removably attached.

19. A shade assembly comprising:

a roller tube;

a shade material connected to the roller tube;

a motor disposed inside the roller tube and adapted to rotate the roller tube to roll and unroll the shade material;

a motor head disposed at a terminal end of the roller tube and comprises a first electrical contact and a first locking member; and an installation bracket adapted to be secured to an architectural structure and comprises a second electrical contact and a second locking member;

wherein the motor head is adapted to removably attach to the installation bracket by connecting the first locking member to the second locking member and thereby aligning and electrically connecting the first electrical contact with the second electrical contact, wherein the motor head is stationary with respect to the installation bracket when the roller tube rotates.

20. A shade assembly comprising:

a roller tube;

a shade material connected to the roller tube;

a motor disposed inside the roller tube and adapted to rotate the roller tube to roll and unroll the shade material;

a motor head disposed at a terminal end of the roller tube and comprises a first electrical contact and a first locking member; and an installation bracket comprising a side wall and a rear wall laterally extending from a rear end of the side wall, wherein the rear wall is adapted to be secured to an architectural structure, wherein the side wall supports a second locking member, wherein the installation bracket comprises a printed circuit board comprising a termination block and a second electrical contact, wherein the rear wall comprises a hole adapted to receive a wire therethrough to be connected with the termination block;

wherein the motor head is adapted to removably attach to the installation bracket by connecting the first locking member to the second locking member and thereby aligning and electrically connecting the first electrical contact with the second electrical contact, wherein the motor head is stationary with respect to the installation bracket when the roller tube rotates.

21. The shade assembly of claim 20, wherein the installation bracket further comprises a removable cover removably connected to the installation bracket and adapted to removably cover a portion of the printed circuit board such that the portion of the printed board is accessible when the removable cover is removed.

* * * * *